US008438677B2

(12) United States Patent
Biersteker

(10) Patent No.: US 8,438,677 B2
(45) Date of Patent: May 14, 2013

(54) CASTER ARRANGEMENT FOR A BARIATRIC LIFT DEVICE

(75) Inventor: Melvin C. Biersteker, Los Angeles, CA (US)

(73) Assignee: Joerns Healthcare, LLC, Stevens Point, WI (US)

( * ) Notice: Subject to any disclaimer, the term of this patent is extended or adjusted under 35 U.S.C. 154(b) by 356 days.

(21) Appl. No.: 12/788,765

(22) Filed: May 27, 2010

(65) Prior Publication Data

US 2011/0289681 A1 Dec. 1, 2011

(51) Int. Cl.
*A61G 7/14* (2006.01)

(52) U.S. Cl.
USPC ..... 5/86.1; 5/89.1

(58) Field of Classification Search ..... 5/81.1 R, 5/86.1, 89.1, 83.1, 85.1, 87.1, 87; 16/47
See application file for complete search history.

(56) References Cited

U.S. PATENT DOCUMENTS

| | | | | |
|---|---|---|---|---|
| 6,405,393 | B2 | 6/2002 | Megown | |
| 2001/0023507 | A1 | 9/2001 | James | |
| 2001/0047546 | A1* | 12/2001 | Megown | 5/611 |
| 2007/0006381 | A1* | 1/2007 | Tally | 5/86.1 |

FOREIGN PATENT DOCUMENTS

| | | | |
|---|---|---|---|
| EP | 0241096 | A2 | 10/1987 |
| JP | 2000116724 | A | 4/2000 |

OTHER PUBLICATIONS

International Search Report and Written Opinion, Application No. PCT/US2011/038020, Dated Feb. 16, 2012.

* cited by examiner

*Primary Examiner* — Fredrick Conley
(74) *Attorney, Agent, or Firm* — MacMillan, Sobanski & Todd, LLC

(57) ABSTRACT

A patient lift includes a base and a mast extending from the base. The patient lift also includes a first elongated leg having a first longitudinal axis extending from the base. A first caster assembly is mounted for pivotal movement relative to the first elongated leg about a first carriage axis. The first caster assembly includes a first caster truck and a plurality of first assembly casters mounted to the first caster truck. The patient lift also includes a second elongated leg having a second longitudinal axis extending from the base. A second caster assembly is mounted for pivotal movement relative to the second elongated leg about a second carriage axis. The second caster assembly includes a second caster truck and a plurality of second assembly casters mounted to the second caster truck.

13 Claims, 3 Drawing Sheets

CASTER ARRANGEMENT FOR A BARIATRIC LIFT DEVICE

BACKGROUND OF THE INVENTION

This invention relates in general to patient lifting and transferring. In particular, the invention relates to a device for lifting a patient from a bed or some other apparatus (wheelchair, bath, etc.) and permitting the patient to be readily moved.

It is often desirable to assist a patient or disabled person in moving from a bed, chair, or other position. This is particularly useful when the patient lacks the strength or coordination to lift himself. To assist these patients, it is common to have a patient lifting hoist, which can raise a person in a sitting or lying position. An attendant or caregiver may be required to assist the patient in using the device.

A lifting hoist typically includes a sling for supporting a patient. The sling may be lifted by a movable arm. In a lifting hoist, the patient is typically completely supported from an overhead position and has no active role in supporting himself. A lifting hoist is commonly used to temporarily raise a patient or transport the patient without discomfort.

In order for a lifting hoist to be used to transport a supported patient, the lifting hoist typically includes wheels or casters. These casters allow the attendant to roll the lifting hoist on the support surface while the patient is supported in the sling.

SUMMARY OF THE INVENTION

This invention relates to a patient lift. The patient lift includes a base and a mast extending from the base. The patient lift also includes a first elongated leg having a first longitudinal axis extending from the base. A first caster assembly is mounted for pivotal movement relative to the first elongated leg about a first carriage axis. The first caster assembly includes a first caster truck and a plurality of first assembly casters mounted to the first caster truck. The patient lift also includes a second elongated leg having a second longitudinal axis extending from the base. A second caster assembly is mounted for pivotal movement relative to the second elongated leg about a second carriage axis. The second caster assembly includes a second caster truck and a plurality of second assembly casters mounted to the second caster truck.

This invention further relates to a patient lift including a base and a mast adapted to support a patient load extending from the base in a first direction. The patient lift includes an elongated leg with a longitudinal axis extending from the base. A rear caster is mounted to the base or the elongated leg and is adapted to support the base relative to a support surface. A caster assembly is mounted relative to the elongated leg. The caster assembly includes a plurality of assembly casters adapted to support the elongated leg relative to the support surface. The caster assembly is adapted to maintain the plurality of assembly casters in contact with the support surface when the mast is supporting the patient load and when the mast is not supporting the patient load.

This invention further relates to a patient lift that includes a base and a mast that extends from the base in a first direction. The mast is adapted to support a patient load. The patient lift includes a first elongated leg having a first longitudinal axis extending from the base in a forward direction. The first elongated leg is mounted for pivotal movement relative to the base wherein the first longitudinal axis remains substantially parallel to a support surface. The patient lift also includes a first caster assembly mounted for pivotal movement relative to the first elongated leg. The first caster assembly includes a plurality of first assembly casters adapted to support the first elongated leg relative to the support surface. The plurality of first assembly casters includes a first rearward assembly caster and a first forward assembly caster located farther from the base along the first longitudinal axis than the first rearward assembly caster. The first caster assembly is adapted so that when the mast is supporting the patient load the first elongated leg is elastically deformed and first caster assembly maintains the plurality of first assembly casters in contact with the support surface. The patient lift also includes a second elongated leg having a second longitudinal axis extending from the base in a forward direction. The second elongated leg is mounted for pivotal movement relative to the base wherein the second longitudinal axis remains substantially parallel to a support surface. The patient lift also includes a second caster assembly mounted for pivotal movement relative to the second elongated leg. The second caster assembly includes a plurality of second assembly casters adapted to support the second elongated leg relative to the support surface. The plurality of second assembly casters includes a second rearward assembly caster and a second forward assembly caster located farther from the base along the second longitudinal axis than the second rearward assembly caster. The second caster assembly is adapted so that when the mast is supporting the patient load the second elongated leg is elastically deformed and second caster assembly maintains the plurality of second assembly casters in contact with the support surface. The patient lift also includes a rear caster mounted relative to one of the base, the first elongated leg and the second elongated leg. The rear caster is adapted to support the base relative to the support surface. The base, first elongated leg and second elongated leg are adapted so that the first longitudinal axis is substantially coplanar with the second longitudinal axis.

Various aspects of this invention will become apparent to those skilled in the art from the following detailed description of the preferred embodiment, when read in light of the accompanying drawings.

DETAILED DESCRIPTION OF THE PREFERRED EMBODIMENT

Figure 1:
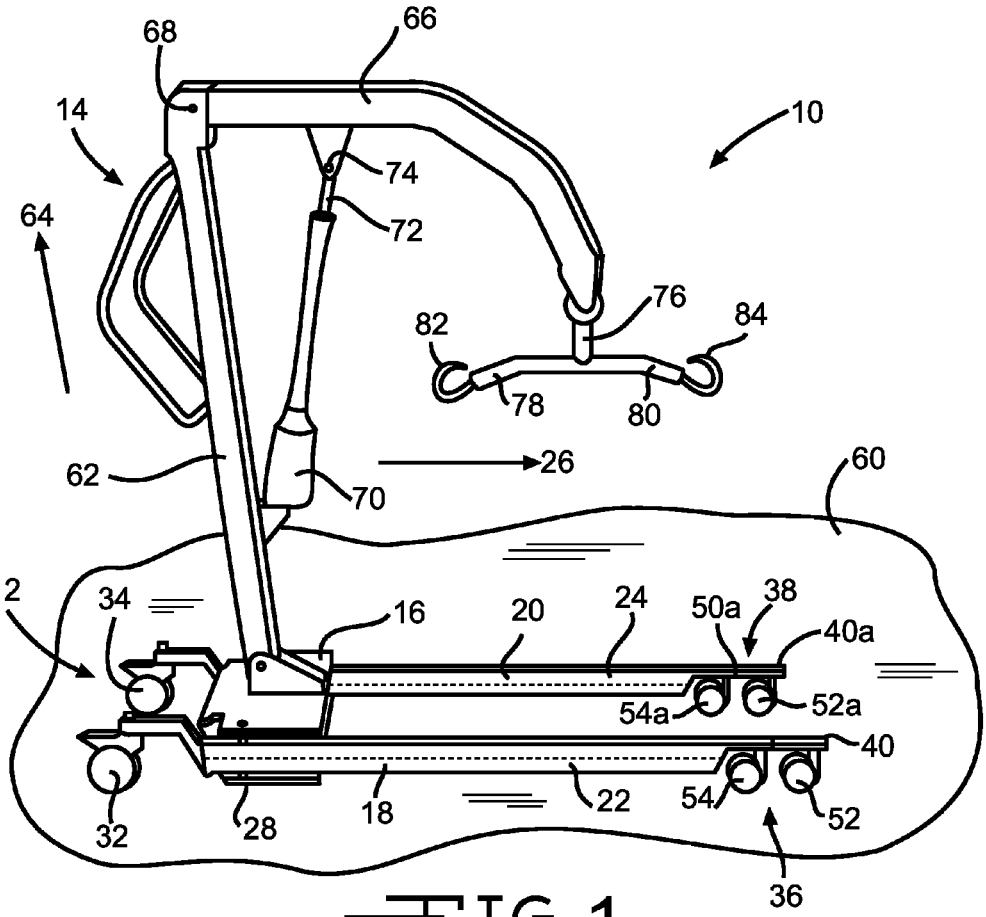
FIG. 1 is a perspective view of a patient lift.

Referring now to the drawings, there is illustrated in FIG. 1 one embodiment of a patient lift 10. The illustrated patient lift 10 is a patient lifting hoist. The patient lift 10 includes a base assembly indicated generally at 12, and a mast assembly indicated generally at 14. The components of the patient lift 10 may be made of metal, plastic, or other desired materials.

The base assembly 12 includes a base 16. The base assembly 12 also includes a first elongated leg 18 and a second elongated leg 20 that extend from the base 16. The first elongated leg 18 and the second elongated leg 20 on the illustrated patient lift 10 are substantially similar to each other, and may be interchangeable. In other embodiments the elongated legs may be different from one other. For example, the legs may be of different lengths or have different cross sectional shapes. The first elongated leg includes a first longitudinal axis 22. The second elongated leg includes a second longitudinal axis 24. The first elongated leg 18 and the second elongated leg 20 extend from the base 16 generally in a forward direction, indicated by the arrow 26.

The first elongated leg 18 and the second elongated leg 20 are attached to the base 16 at a first leg hinge 28 and a second leg hinge (not visible in FIG. 1), respectively. The first leg hinge 28 and the second leg hinge allow the first elongated leg 18 and the second elongated leg 20 to pivot relative to the base 16. This allows the first elongated leg 18 and the second elongated leg 20 to be moved through ranges of motion into various positions to facilitate stability, transportation and storage of the patient lift 10. On the illustrated patient lift 10, the first leg hinge 28 and the second leg hinge allow the first leg 18 and the second leg 20 to be positioned such that the first longitudinal axis 22 and the second longitudinal axis 24 are parallel to each other. Additionally, the first leg hinge 28 and the second leg hinge allow the first leg 18 and the second leg 20 to be positioned such that the first longitudinal axis 22 and the second longitudinal axis 24 are not parallel to each other. Throughout the range of motion of the first elongated leg 18 and the second elongated leg 20, the first longitudinal axis 22 and the second longitudinal axis 24 will be substantially coplanar. It should be appreciated that the patient lift 10 may be adapted so that the first longitudinal axis 22 and the second longitudinal axis 24 may be moved into non-coplanar positions, if desired.

The base assembly 12 includes a pair of rear casters 32 and 34. The illustrated rear casters 32 and 34 are mounted for pivotal movement relative to the first elongated leg 18 and the second elongated leg 20, respectively. It should be appreciated that the rear casters 32 and 34 may alternatively be mounted relative to the base 16. The illustrated rear casters 32 and 34 are locking casters; however, other desired types of casters may be used on the patient lift 10. It should also be appreciated that the base assembly 12 may include fewer than or more than the two rear casters 32 and 34 illustrated. For example, the patient lift 10 may have a single rear wheel mounted relative to the base 16.

The base assembly 12 also includes a first caster assembly indicated at 36 and a second caster assembly indicated at 38. The first caster assembly 36 and the second caster assembly 38 are mounted relative to the first elongated leg 18 and the second elongated leg 20, respectively. The first caster assembly 36 is shown in greater detail in FIG. 2. As illustrated, the first caster assembly 36 includes a first caster truck 40. The first caster truck 40 is mounted for pivotal movement relative to the first elongated leg 18. As illustrated, the first elongated leg 18 includes a fork with two tines 42 and 44. The first caster truck 40 includes a tongue 46. The tongue 46 is received between the tines 42 and 44 of the fork. A pivot pin 48 extends through the tines 42 and 44 and the tongue 46. The first caster truck 40 is then able to be pivoted relative to the first elongated leg 18 about a carriage axis 50 that extends through the pivot pin 48. In the first caster assembly 36, the carriage axis 50 is substantially perpendicular to the first longitudinal axis 22. It should be appreciated that the carriage axis 50 may be situated to be other than substantially perpendicular to the first longitudinal axis 22.

The first caster assembly 36 includes a forward assembly caster 52 and a rearward assembly caster 54. It should be appreciated that the forward assembly caster 52 is located farther in the forward direction 26 than the rearward assembly caster 54. This also means that the forward assembly caster 52 is located farther from the base 16 along the first longitudinal axis 22 than the rearward assembly caster 54. In the illustrated embodiment, the forward assembly caster 52 and the rearward assembly caster 54 are the same size. However, any desired combination of sizes of casters may be used. Additionally, it should be appreciated that more than the two casters illustrated on the first caster assembly 36 may be used, if desired.

The forward assembly caster 52 is mounted relative to the first caster truck 40 at a forward assembly caster mounting point 56. The rearward assembly caster 54 is mounted relative to the first caster truck 40 at a rearward assembly caster mounting point 58. In the illustrated first caster assembly 36, the forward assembly caster mounting point 56 is located on a forward side of the carriage axis 50 while the rearward assembly caster mounting point 58 is located on a rearward side of the carriage axis 50. In the illustrated embodiment, the forward assembly caster mounting point 56 and the rearward assembly caster mounting point 58 are located equidistantly from the carriage axis 50. It should be appreciated that the caster mounting points may be located different distances from the carriage axis 50. As also seen in reference to FIG. 2, the forward assembly caster mounting point 56 and the rearward assembly caster mounting point 58 are located in line with the first longitudinal axis 22. However, it should be appreciated that the forward assembly caster mounting point 56 and the rearward assembly caster mounting point 58 may be off set from the first longitudinal axis 22, if desired.

The second caster assembly 38 mounted relative to the second elongated leg 20 is substantially similar to the first caster assembly 36. The mounting of the second caster assembly 38 to the second elongate leg 20 will not be described in detail. The second caster assembly 38 includes a second caster truck **40*a*. The second caster truck 40*a* is mounted for pivotal movement relative to the second elongated leg 20. The second caster truck 40*a* is able to be pivoted relative to the second elongated leg 20 about a second carriage axis 50*a*. In the second caster assembly 38, the second carriage axis 50*a* is substantially perpendicular to the second longitudinal axis 24. It should be appreciated that the second carriage axis 50*a* may be situated to be other than substantially perpendicular to the second longitudinal axis 24**.

The second caster assembly 38 also includes forward assembly caster **52*a* and a rearward assembly caster 54*a*. It should be appreciated that the forward assembly caster 52*a* is located farther in the forward direction 26 than the rearward assembly caster 54*a*. This also means that the forward assembly caster 52*a* is located farther from the base 16 along the second longitudinal axis 24 than the rearward assembly caster 54*a*. In the illustrated embodiment, the forward assembly caster 52*a* and the rearward assembly caster 54*a* are the same size. However, any desired combination of sizes of casters may be used. Additionally, it should be appreciated that more than the two casters illustrated on the second caster assembly 38** may be used, if desired.

Referring back to FIG. 1, the rear casters 32 and 34 and the casters on the first caster assembly 36 and the second caster assembly 38 are adapted to support the patient lift 10 relative to a support surface, such as the floor or the ground, indicated at 60. Therefore, the illustrated patient lift 10 is supported relative the support surface 60 by the rear casters 32 and 34, the forward assembly casters 52 and 52*a*, and the rearward assembly casters 54 and 54*a*.

In continued reference to FIG. 1, the mast assembly of the patient lift 10 includes a mast 62. The mast 62 is mounted on the base 16. The mast 62 extends in a first direction 64 from the base 16. It should be appreciated that the first direction 18 is generally upwards. The mast assembly 14 includes a boom 66 pivotally mounted on the mast 16 at a boom hinge 68. The boom 66 extends from the mast 62 in the forward direction 26. An electric motor 70 is mounted on the mast 16. The electric motor 70 is operable to drive an actuator 72. The actuator 72 is attached to the boom 66 at an actuator hinge 74. The electric motor 70 may be operated to drive the actuator 72 in order to cause the boom 66 to rotate relative to the mast 62.

A support hanger 76 is pivotally supported at a distil end of the boom 66. The illustrated support hanger 76 includes two extending arms 78 and 80. A hook 82 and a hook 84 are located at the ends of the extending arms 78 and 80, respectively. The hooks 82 and 84 are adapted to support a sling (not shown). The sling may be attached to a patient or other load (not shown). When the sling is attached to a patient and is supported by the hooks 82 and 84, the electric motor 70 may be operated to cause the boom 66 to rotate relative to the mast 62. This allows the patient to be raised and lowered relative to the support surface 60 by the patient lift 10.

Figure 3:
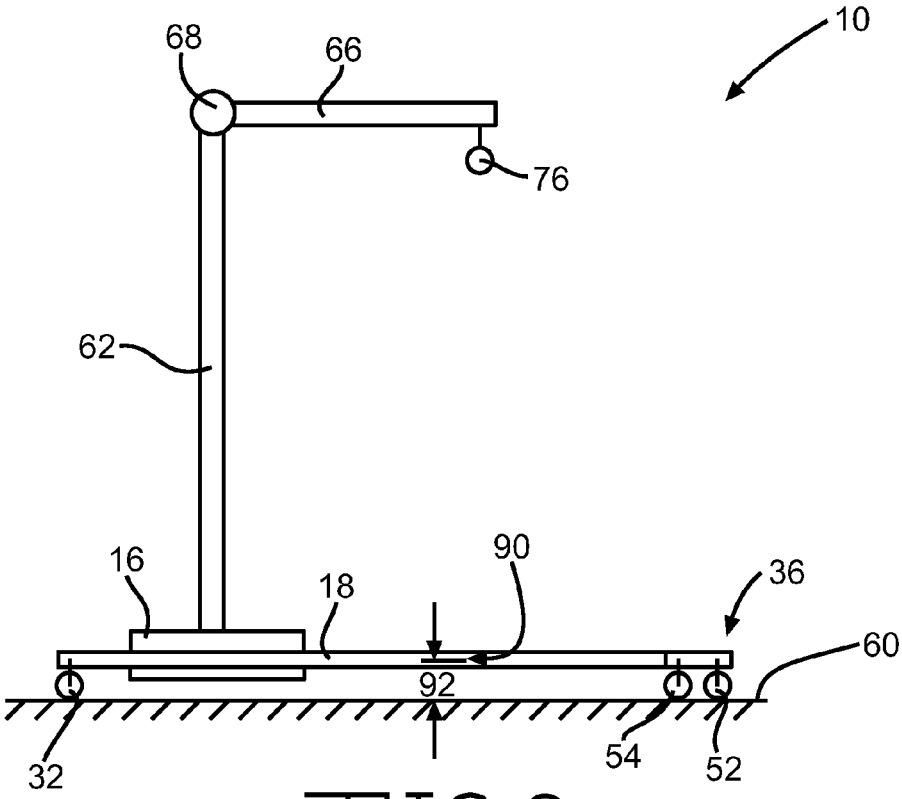
FIG. 3 is a schematic view, taken from the side, of the patient lift of FIG. 1, illustrating the patient lift in an unloaded state.

Referring now to FIG. 3, there is shown a schematic view, taken from the side, of the patient lift 10. The patient lift 10 is supported on the support surface 60 by the rear casters 32 and 34, the forward assembly casters 52 and 52*a*, and the rearward assembly casters 54 and 54*a*. It should be appreciated that the rear caster 34, the forward assembly caster 52*a*, and the rearward assembly caster 54*a* are not visible in this figure. However, each of the casters is in contact with the support surface 60 and is bearing some of the weight of the patient lift 10.

Figure 4:
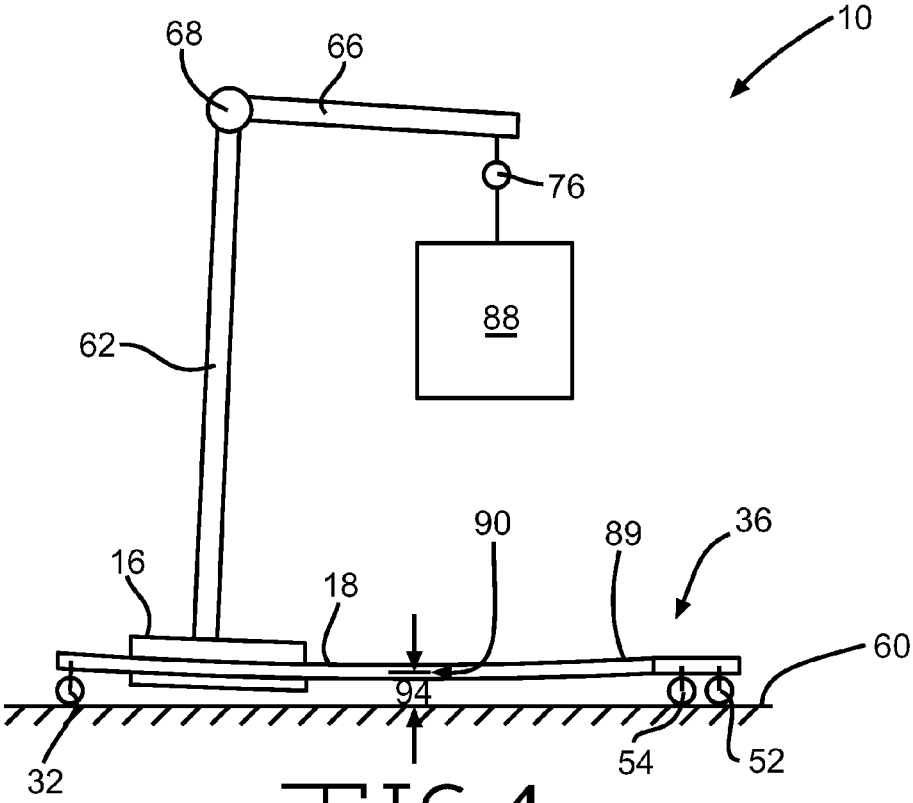
FIG. 4 is a schematic view similar to that shown in FIG. 3, illustrating the patient lift in a loaded state.

Referring now to FIG. 4, there is shown a schematic view similar to that shown in FIG. 3, with a load 88 supported by the patient lift 10. It should be appreciated that the load 88 may be a patient load, or any other weight supported by the lift. When the load 88 is supported by the patient lift 10 the weight of the load 88 may cause deformation of the components of the patient lift 10. For example, the load 88 applies a force to the boom 66 that is transmitted to the mast 62. The force is applied to through the base 16 to the first elongated leg 18 and the second elongated leg 20. This force may cause one or more of the components of the lift to bend or deflect. As illustrated in FIG. 4, the force may cause the first elongated leg 18 to bend between the support provided by the rear caster 32 and the forward caster assembly 36. The first elongated leg 18 is shown deflected and deformed into a bent shape and a distil end 89 of the first elongated leg 18 is at an angle relative to the support surface. It should be appreciated that the second elongated leg 20, not visible in FIG. 3 or 4, may also be deformed when the load 88 is supported by the patient lift 10.

Referring back to FIG. 3, the first elongated leg 18 includes an intermediate point 90 located between the base 16 and the carriage axis 50. It should be appreciated that the intermediate point 90 is located approximately half way between the base 16 and the carriage axis 50, but that the intermediate point 90 may be located at some other position on the first elongated leg 18. When the patient lift 10 is not supporting the load 88, the intermediate point 90 is an unloaded distance 92 from the support surface 60. Referring to FIG. 4, when the patient lift 10 is supporting the load 88 the intermediate point 90 is a loaded distance 94 from the support surface 60. As can be seen by comparing FIGS. 3 and 4, the unloaded distance 92 is greater than the loaded distance 94.

The amount of deformation caused by the load 88 will depend on the materials and dimensions of the components used to make the patient lift 10, and the weight of the load 88. For example, if the patient lift 10 is made of stiffer materials it will tend to deform less when loaded. It should be appreciated that for any given design of the patient lift 10 there will be some range of weight of the load 88 that will cause no appreciable deformation of the patient lift 10. Further, the greater the weight of the load 88 the greater the amount of deformation that will take place. There will generally be some range of weight of the load 88 that will cause elastic deformation of the patient lift 10. That is, the patient lift 10 will deform when it is supporting the load 88, but will reform substantially to its original shape when the load 88 is removed. There will also be some weight of the load 88 that will cause plastic deformation of the patient lift 10. If the patient lift 10 is plastically deformed then it will not revert to its original shape when the load 88 is removed.

Figure 5:
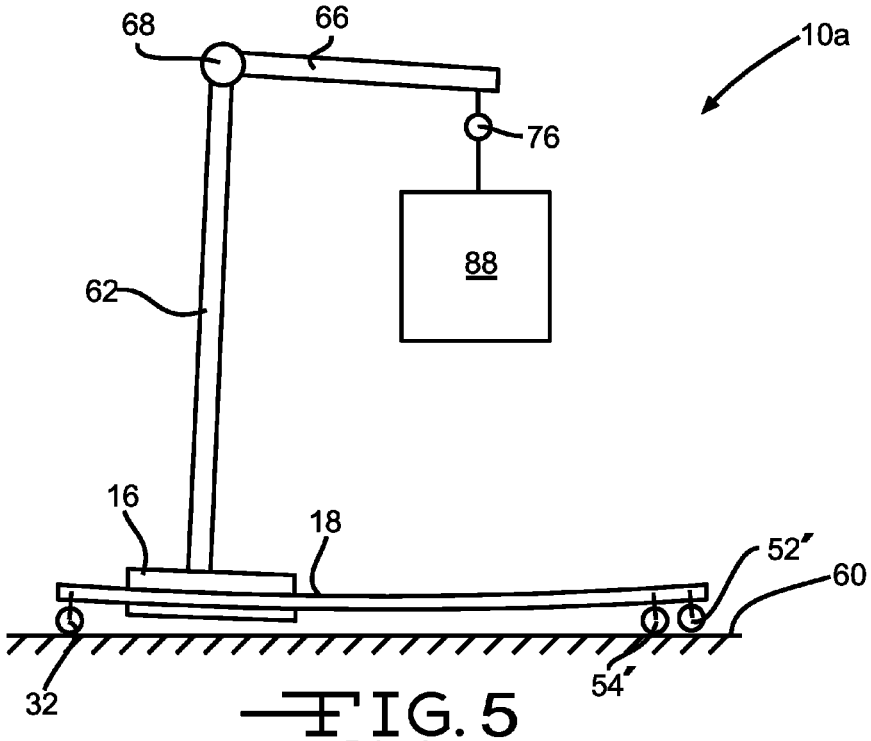
FIG. 5 Prior Art
FIG. 5 is a schematic view of a loaded lift that is equipped with a prior art caster array.

Referring now to FIG. 5, a schematic side view of a loaded prior art patient lift 10*a* is shown. The patient lift 10*a* is similar to the patient lift 10, and components of the patient lift 10*a* that are similar to components of the patient lift 10 are identified using like numbers. The patient lift 10*a* does not include the caster assembly 36 and the caster assembly 38. Instead, a forward leg caster 52' and a rearward leg caster 54' are mounted directly on the first elongated leg 18. Additionally, though not visible in FIG. 5, a forward leg caster and a rearward leg caster are mounted directly on the second elongated leg. As shown in FIG. 5, sufficient deformation of the patient lift 10*a* may result in one or more of the casters losing contact with the support surface 60. In particular, if the first elongated leg 18 is bent sufficiently, the forward leg caster 52' may no longer be in contact with the support surface 60. This would result in the combined weight of the patient lift 10*a* and the load 88 being supported by fewer casters with additional weight being supported by the rearward leg caster 54'. This would therefore require that the rearward leg caster 54' be sized to accommodate this larger load. It should be appreciated that FIG. 5 illustrates the patient lift 10*a* in an overloaded condition. It is contrary to the purpose of including both the forward leg caster 52' and the rearward leg caster 54' if the rearward leg caster 54' is sized to support the load alone. Therefore, in order to support the load 88, the patient lift 10*a* would have to be provided with a stiffer first elongated leg 18 and a stiffer second elongated leg 20, or a bigger, more robust rearward leg caster 54'.

Figure 2:
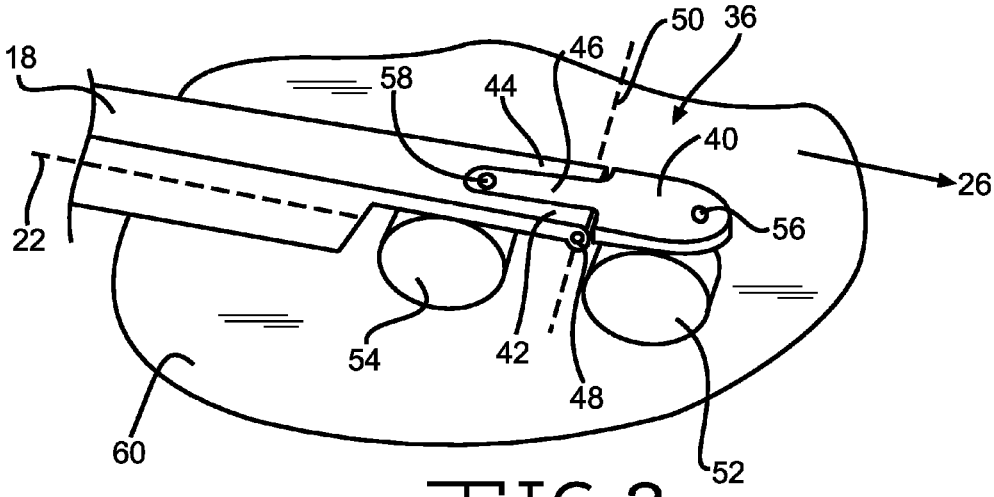
FIG. 2 is a perspective view of a distil end of an elongated leg and a caster assembly of the patient lift of FIG. 1.

In reference back to FIG. 2, the operation of the caster assembly 36 will be described. As previously described, the caster assembly 36 is attached to the first elongated leg 18 by the pivot pin 48. This allows the first caster truck 40 to rotate relative to the first elongated leg 18 about the carriage axis 50. It should be appreciated that this allows the forward assembly caster 52 and the rearward assembly caster 54 to remain in contact with the support surface 60 when the first elongated leg 18 is moved to a variety of orientations relative to the support surface 60. If the first elongated leg 18 is deformed due to the load 88, both the forward assembly caster 52 and the rearward assembly caster 54 will still remain in contact with the support surface 60. Therefore, the caster assembly 36 allows both the forward assembly caster 52 and the rearward assembly caster 54 to continue to support the applied load even when the first elongated leg 18 is deformed. This is shown in the schematic view in FIG. 4. The patient lift 10 is not illustrated in an overloaded condition in FIG. 4. The patient lift 10 is able to support the load 88 without requiring a stiffer first elongated leg 18 and a stiffer second elongated leg 20. The use of the caster assembly 36 allows the patient lift 10 to be made using a rearward assembly caster 54 that is less robust than the rearward leg caster 54' on the prior art patient lift (shown in FIG. 5).

Figure 6:
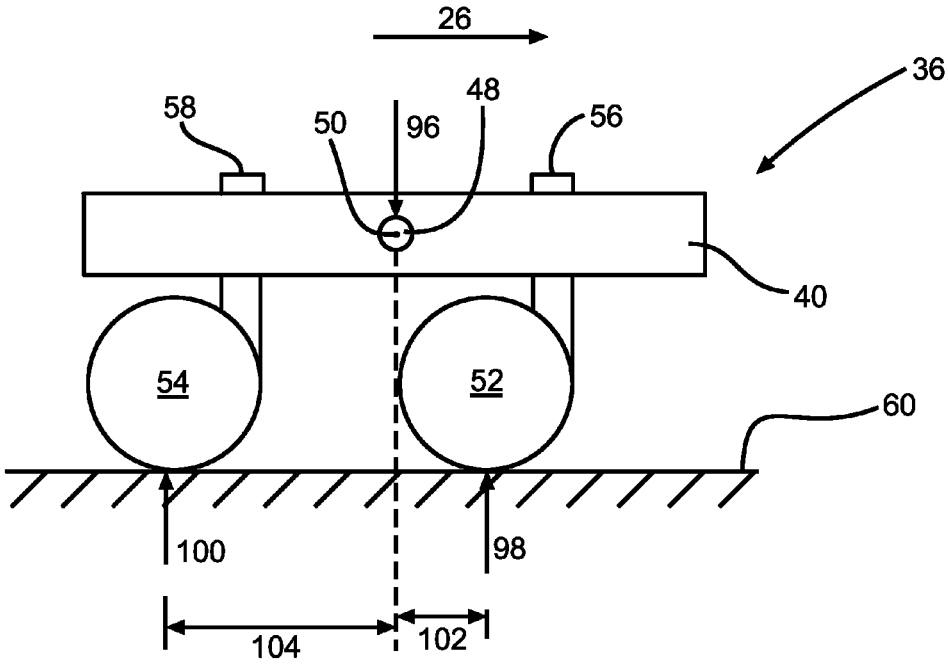
FIG. 6 is a side view of the caster assembly of the patient lift of FIG. 4, illustrating the forces on the caster assembly.

Referring to FIG. 6, a schematic free body diagram of the caster assembly 36 is illustrated. As shown, an assembly force 96 is applied on the first caster truck 40 by the first elongated leg 18. It should be appreciated that the assembly force 96 is a portion of the combined weight of the patient lift 10 and the load 88. The assembly force 96 is balanced by a forward assembly force 98 and a rearward assembly force 100 applied on the caster assembly 36 by the support surface 60. The forward assembly force 98 and the rearward assembly force 100 are applied to the forward assembly caster 52 and the rearward assembly caster 54, respectively. It should be appreciated that when the forward assembly caster 52 and the rearward assembly caster 54 are on opposed sides of the carriage axis 50, both the forward assembly caster 52 and the rearward assembly caster 54 will be subjected to a force applied by the support surface 60.

The total magnitude of the forward assembly force 98 and the rearward assembly force 100 is equal to the magnitude of the assembly force 96. The relative magnitude of the forward assembly force 98 and the rearward assembly force 100 will depend on the relative size of a forward distance 102 and a rearward distance 104. The forward distance 102 is the separation between the carriage axis 50 and the point of contact between the forward assembly caster 52 and the support surface 60, measured along the support surface 60. The rearward distance 104 is the separation between the carriage axis 50 and the point of contact between the rearward assembly caster 54 and the support surface 60, measured along the support surface 60. The forward assembly caster 52 is swivel mounted so that it may be pivoted relative to the first caster truck 40 about the forward assembly caster mounting point 56. Similarly, the rearward assembly caster 54 is swivel mounted so that it may be pivoted relative to the first caster truck 40 about the rearward assembly caster mounting point 58. As a result, the relative size of the forward distance 102 and the rearward distance 104 may change and the relative magnitude of the forward assembly force 98 and the rearward assembly force 100 may also change.

It should be appreciated that one or both of the forward assembly caster 52 and the rearward assembly caster 54 may be adapted for limited motion relative to the first caster truck 40. This limited motion could limit the amount of variation between the forward assembly force 98 and the rearward assembly force 100. For example, if the caster assembly 36 is adapted so that the forward distance 102 and the rearward distance 104 remain the same, then the forward assembly force 98 and the rearward assembly force 100 will also remain the same. Additionally, it should be appreciated that the caster assembly 36 may be adapted to control the relative spacing for the casters. For example, the caster assembly 36 may be adapted such that the forward distance 102 is always greater than the rearward distance 104. This would result in the rearward assembly force 100 being greater than the forward assembly force 98. This may allow the caster assembly 36 to include a smaller forward assembly caster 52 and a larger rearward assembly caster 54.

It should also be appreciated that while the illustrated caster assembly 36 includes a single forward assembly caster 52 and a single rearward assembly caster 54, the caster assembly 36 may include additional casters or other supports in front of and behind the carriage axis 50. These additional casters may reduce the amount of weight supported by each caster.

The illustrated patient lift 10 is a patient lifting hoist. However, the caster assembly described may also be used on other types of desired lifts, such as a stand assist device.

The principle and mode of operation of this invention have been explained and illustrated in its preferred embodiment. However, it must be understood that this invention may be practiced otherwise than as specifically explained and illustrated without departing from its spirit or scope.

What is claimed is:

1. A patient lift comprising:

a base;

a mast extending from the base;

a first elongated leg extending from the base, the first elongated leg having a first longitudinal axis;

a first caster assembly including a first caster truck mounted for pivotal movement relative the first elongated leg about a first carriage axis, the first caster assembly further including a plurality of first assembly casters mounted to the first caster truck;

a second elongated leg extending from the base, the second elongated leg having a second longitudinal axis; and a second caster assembly including a second caster truck mounted for pivotal movement relative the second elongated leg about a second carriage axis, the second caster assembly further including a plurality of second assembly casters mounted to the second caster truck.

2. The patient lift of claim 1, wherein one of the first elongated leg and the first caster truck defines a fork with tines and the other of the first elongated leg and the first caster truck defines a tongue received between the tines of the fork.

3. The patient lift of claim 2, wherein the tines extend substantially parallel to the first longitudinal axis.

4. The patient lift of claim 1, wherein the first elongated leg is elastically deformed when the mast is supporting a patient load.

5. The patient lift of claim 4, wherein the plurality of first assembly casters includes a rearward assembly caster and a forward assembly caster located farther from the base along the first longitudinal axis than the rearward assembly caster.

6. The patient lift of claim 5, further comprising a second elongated leg extending from the base along a second longitudinal axis; and a second caster assembly mounted for pivotal movement relative the second elongated leg, the second caster assembly including a plurality of second assembly casters adapted to support the second elongated leg relative to the support surface, the plurality of second assembly casters including a second rearward assembly caster and a second forward assembly caster located farther from the base along the second longitudinal axis than the second rearward assembly caster;

wherein the second elongated leg is elastically deformed when the mast is supporting the patient load, and the second caster assembly is adapted to maintain the plurality of second assembly casters in contact with the support surface when the mast is supporting the patient load and when the mast is not supporting the patient load.

7. The patient lift of claim 6, wherein the second longitudinal axis is substantially coplanar with the first longitudinal axis when the mast is not supporting the patient load.

8. The patient lift of claim 7, wherein the second longitudinal axis is non-parallel with the first longitudinal axis.

9. A patient lift comprising:

a base;

a mast extending from the base;

a first elongated leg extending from the base, the first elongated leg having a first longitudinal axis;

a first caster assembly including a first caster truck mounted for pivotal movement relative the first elongated leg about a first carriage axis, the first caster assembly further including a forward assembly caster mounted to the first caster truck at a forward assembly caster mounting point and a rearward assembly caster mounted relative to the first caster truck at a rearward assembly caster mounting point, wherein the forward assembly caster mounting point and the rearward assembly caster mounting point are located in line with the first longitudinal axis;

a second elongated leg extending from the base, the second elongated leg having a second longitudinal axis; and a second caster assembly including a second caster truck mounted for pivotal movement relative the second elongated leg about a second carriage axis, the second caster assembly further including a forward assembly caster mounted to the second caster truck at a second forward assembly caster mounting point and a rearward assembly caster mounted relative to the second caster truck at a second rearward assembly caster mounting point, wherein the second forward assembly caster mounting point and the second rearward assembly caster mounting point are located in line with the second longitudinal axis.

10. The patient lift of claim 9, wherein one of the first elongated leg and the first caster truck defines a fork with tines and the other of the first elongated leg and the first caster truck defines a tongue received between the tines of the fork.

11. The patient lift of claim 10, wherein the first carriage axis extends through the tines and the tongue.

12. The patient lift of claim 9, wherein the first caster assembly maintains the forward assembly caster and the rearward assembly caster in contact with a support surface when the mast is supporting a patient load and when the mast is not supporting the patient load.

13. The patient lift of claim 12, wherein the first elongated leg is elastically deformed when the mast is supporting the patient load.

* * * * *